US007008274B2

(12) United States Patent
Hayashi et al.

(10) Patent No.: US 7,008,274 B2
(45) Date of Patent: Mar. 7, 2006

(54) CRIMP CONTACT WHICH CAN EASILY BE REDUCED IN SIZE

(75) Inventors: Yasufumi Hayashi, Tokyo (JP); Seiichi Hara, Tokyo (JP); Kiyohito Koide, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 10/994,945

(22) Filed: Nov. 22, 2004

(65) Prior Publication Data

US 2005/0112961 A1 May 26, 2005

(30) Foreign Application Priority Data

Nov. 26, 2003 (JP) ..... 2003-395678

(51) Int. Cl.
*H01R 4/10* (2006.01)

(52) U.S. Cl. ..... 439/877

(58) Field of Classification Search ..... 439/877; 174/84 C; D13/154, 133
See application file for complete search history.

(56) References Cited

U.S. PATENT DOCUMENTS 2,483,424 A * 10/1949 Martines ..... 439/877
2,747,171 A * 5/1956 Martines ..... 439/877
3,115,244 A * 12/1963 Laskowski ..... 439/877
3,248,686 A * 4/1966 Ruehlemann ..... 439/877
3,953,103 A * 4/1976 Mathis ..... 439/877
4,812,138 A 3/1989 Kondo et al.
5,567,187 A * 10/1996 Bellinger ..... 439/877
6,000,976 A * 12/1999 Takagishi et al. ..... 439/877

FOREIGN PATENT DOCUMENTS

| | | |
|---|---|---|
| EP | 1 020 955 | 7/2000 |
| EP | 1 154 520 | 11/2001 |
| GB | 907 317 | 10/1962 |
| JP | 5343109 | 12/1993 |
| JP | 11 297375 | 10/1999 |
| JP | 112973375 | 10/1999 |

* cited by examiner

*Primary Examiner*—Tho D. Ta
(74) *Attorney, Agent, or Firm*—Collard & Roe, P.C.

(57) ABSTRACT

In a crimp contact to be connected to a cable having a conductive core wire and an insulating cladding portion covering the core wire, the crimp contact has a cladding crimping portion for crimping the cladding portion and a core wire crimping portion arranged adjacent to the cladding crimping portion for crimping the core wire. The core wire crimping portion has a base portion for receiving the core wire and a first core wire barrel extending from the base portion for crimping the core wire to cover an outside of the core wire. The first core wire barrel has a relatively longer length from the base portion at a part relatively far from the cladding crimping portion and a relatively shorter length from the base portion at another part relatively near to the cladding crimping portion.

8 Claims, 2 Drawing Sheets

CRIMP CONTACT WHICH CAN EASILY BE REDUCED IN SIZE

This application claims priority to prior Japanese Patent Application JP 2003-395678, the disclosure of which is incorporated herein by reference.

BACKGROUND OF THE INVENTION

This invention relates to a crimp contact to be connected to a core wire of a cable by crimping.

A conventional crimp contact has a core wire crimping portion for crimping a core wire of a cable and a cladding crimping portion for crimping a cladding portion covering the core wire of the cable (for example, see Japanese Patent Application Publication (JP-A) No. H5-343109). Another conventional crimp contact comprises a core wire crimping portion and a cladding crimping portion each of which has a pair of metal members opposite to each other and which is different in height from the core wire crimping portion (for example, see Japanese Patent Application Publication (JP-A) No. H11-297375).

In the crimp contact of the type, it is supposed that the core wire is subjected to a bending stress in an area between crimped portions crimped by the core wire crimping portion and the cladding crimping portion, respectively. In view of the above, it is desired to increase a distance between the core wire crimping portion and the cladding crimping portion to reduce the stress applied to the core wire by crimping. However, if the distance between the core wire crimping portion and the cladding crimping portion is increased, a whole of the crimp contact can not be reduced in size.

Sometimes, the core wire of the cable is wound around the crimp contact. In this event, an operation of winding the core wire is complicated and is therefore difficult to automate, resulting in low productivity. Further, a special crimping tool is required which is provided with an escape portion for the core wire wound around the crimp contact.

SUMMARY OF THE INVENTION

It is therefore an object of the present invention to provide a small-sized crimp contact capable of reducing a bending stress of a core wire of a cable connected to the crimp contact.

It is another object of the present invention to provide a crimp contact of the type described, which easily enables automatic connection of a core wire of a cable.

Another objects of the present invention will become clear as the description proceeds.

According to an aspect of the present invention, there is provided a crimp contact to be connected to a cable having a conductive core wire and an insulating cladding portion covering the core wire, the crimp contact comprising a cladding crimping portion for crimping the cladding portion and a core wire crimping portion arranged adjacent to the cladding crimping portion for crimping the core wire, the core wire crimping portion comprising a base portion for receiving the core wire and a first core wire barrel extending from the base portion for crimping the core wire to cover an outside of the core wire, the first core wire barrel having a relatively longer length from the base portion at a part relatively far from the cladding crimping portion and a relatively shorter length from the base portion at another part relatively near to the cladding crimping portion.

DESCRIPTION OF THE PREFERRED EMBODIMENT

Figure 1:
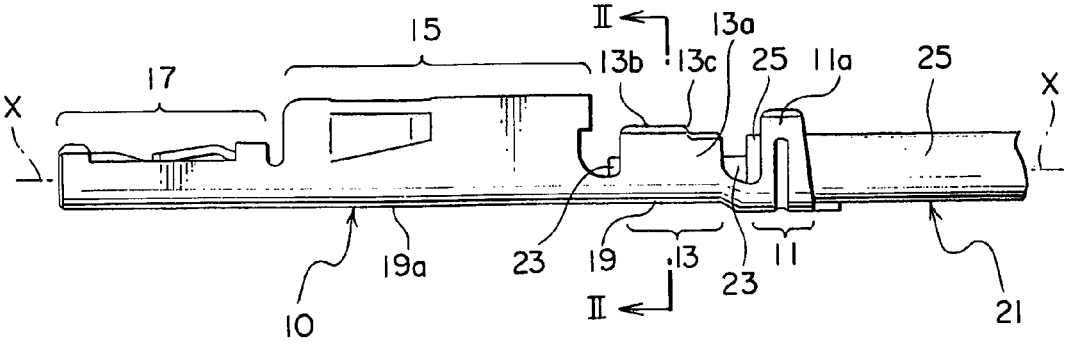
FIG. 1 is a side view of a crimp contact according to an embodiment of the present invention in relation to a cable before the cable is held by the crimp contact.

Referring to FIG. 1, a crimp contact according to an embodiment of the present invention will be described.

The crimp contact 10 illustrated in the figure has a cladding crimping portion 11, a core wire crimping portion 13 adjacent to one side of the cladding crimping portion 11, a holding portion 15 adjacent to one side of the core wire crimping portion 13, and a contacting portion 17 adjacent to one side of the holding portion 15. The cladding crimping portion 11, the core wire crimping portion 13, the holding portion 15, and the contacting portion 17 are arranged at predetermined intervals from one another in a predetermined direction parallel to one axis X and are connected to one another by a common base 19.

The cladding crimping portion 11 is a portion for holding an insulating cladding portion 25 covering a conductive core wire 23 of a cable 21. The core wire crimping portion 13 is a portion for collectively holding the core wire 23 comprising a plurality of lead wires exposed from one end of the cladding portion 25 of the cable 21 and extending in the predetermined direction. The holding portion 15 is a portion to be inserted into and held by a receiving portion of an insulator (not shown). The contacting portion 17 is a portion extending from one end of the core wire crimping portion 13 in the predetermined direction to be contacted with a mating contact (not shown).

Figure 2:
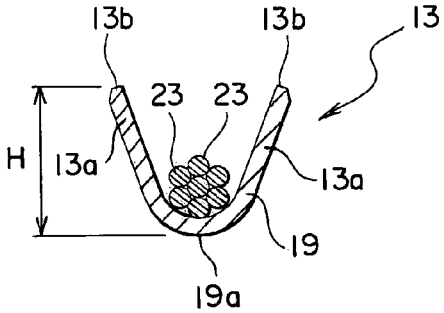
FIG. 2 is an enlarged sectional view taken along a line II—II in FIG. 1.

The cladding crimping portion 13 has a pair of cladding barrels 11*a* extending from opposite sides of the base portion 19, which are parallel to the predetermined direction, and faced to each other with a space left therebetween. The cladding barrels 11*a* are bent inward around the cladding portion 25 of the cable 21 placed on the base portion 19 so as to cover the cladding portion 25. Thus, the cladding portion 25 is held by crimping. As shown in FIG. 2 also, the core wire crimping portion 13 has a pair of core wire barrels 13*a* extending from the opposite sides of the base portion 19, which are parallel to the predetermined direction, and faced to each other with a space left therebetween. The core wire barrels 13*a* form a first core wire barrel and a second core wire barrel, respectively.

Figure 3:
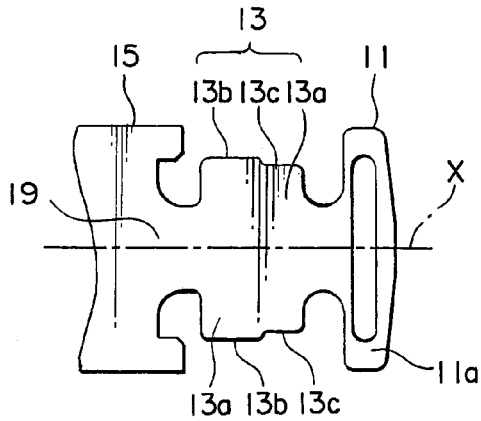
FIG. 3 is a development plan view of a cladding crimping portion and a core wire crimping portion of the crimp contact illustrated in FIG. 1.

Referring to FIG. 3 in addition, a method of producing the crimp contact 10 will briefly be described. FIG. 3 shows the cladding crimping portion 11 and the core wire crimping portion 13 of the crimp contact 10 in a developed shape.

A thin conductive metal plate is punched to obtain the crimp contact 10 in a developed shape. Thereafter, a predetermined bending process is carried out to form the crimp contact 10. Specifically, after the developed shape in FIG. 3 is obtained, the cladding crimping portion 11 and the core wire crimping portion 13 are formed by the bending process so that the cladding barrels 11*a* are faced to each other and that the core wire barrels 13*a* are faced to each other.

Next referring to FIGS. 1 and 2, the core wire crimping portion 13 will be described.

As described above, the core wire crimping portion 13 has the core wire barrels 13*a* extending from the opposite sides of the base portion 19 and faced to each other with a space left therebetween. As best shown in a sectional view in FIG. 2, the core wire crimping portion 13 exhibits a generally U-shaped section formed by the core wire barrels 13*a* and the base portion 19. Although not shown in the figure, the cladding crimping portion 11 exhibits a generally U-shaped section formed by the cladding barrels 11*a* and the base portion 19.

The core wire crimping portion 13 has a special shape in which a height H (see FIG. 2) from a base surface 19*a* of the base portion 19 to an extending end 13*b* of each core wire barrel 13*a* is changed stepwise at an intermediate point in the predetermined direction. Specifically, each core wire barrel 13*a* has a step portion 13*c* between a first part and a second part where the extending end 13*b* is high and low, respectively. The first part is relatively far from the cladding crimping portion 11 than the intermediate point in the predetermined direction. The second part is relatively near to the cladding crimping portion 11 than the intermediate point in the predetermined direction. In other words, the first part of each core wire barrel 13*a* has a shorter length from the base portion 19 than that of the second part.

Figure 4:
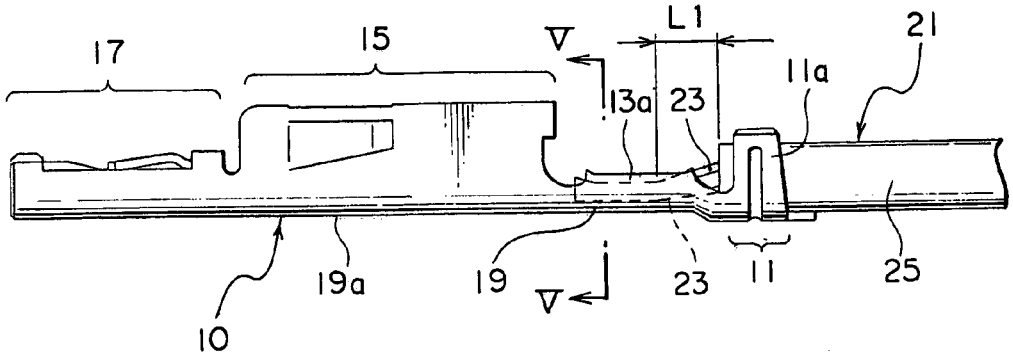
FIG. 4 is a side view of the crimp contact in FIG. 1 when the cable is held by the crimp contact.
Figure 5:
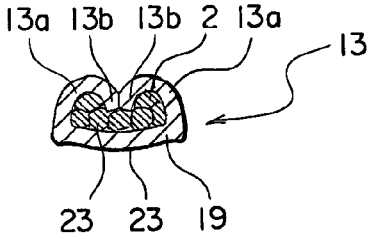
FIG. 5 is an enlarged sectional view taken along a line V—V in FIG. 4.

Referring to FIGS. 4 and 5 in addition, an operation of connecting the crimp contact 10 to the cable 21 will be described.

At first, the cladding portion 25 at an end portion of the cable 21 is removed to expose the core wire 23. The cable 21 is put on the base portion 19. At this time, the core wire 23 and the cladding portion 25 are positioned at the core wire crimping portion 13 and the cladding crimping portion 11, respectively. In this state, the core wire barrels 13*a* and the cladding barrels 11*a* are bent inward so as to cover the core wire 23 and the cladding portion 25 from the outside, respectively. Thus, the core wire 23 and the cladding portion 25 are held by the core wire crimping portion 13 and the cladding crimping portion 11 by crimping, respectively.

When the core wire 23 is crimped, the extending ends 13*b* of the core wire barrels 3*a* become in contact with to each other at a center of the base portion 19 in a direction perpendicular to the predetermined direction. Thus, the core wire barrels 13*a* are inwardly bent from opposite sides of the core wire 23 to be uniformly rolled inside. The extending ends 13*b* of the core wire barrels 13*a* are curled towards the center of the core wire 23 to collapse a whole of the core wire 23 in a vertical direction and to clamp the core wire 23. Such crimping operation is carried out by a known bending/crimping tool, such as a crimper or an anvil known in the art, for bending the core wire barrels 13*a*.

By providing the core wire barrels 13*a* with the step portions 13*c*, it is possible to delay bending of the second part, i.e., the part nearer to the cladding crimping portion 11 than the step portion 13*c* at an early stage of crimping. Therefore, it is possible to slowly clamp the core wire 23 at a specific part having a length L1 in FIG. 4. As a consequence, a damage upon the core wire 23 by crimping is reduced to thereby minimize a loss of a tensile strength of the cable 21 and maintain a sufficient tensile strength. Further, the bending stress of the core wire 23 between the crimped portions crimped by the core wire crimping portion 13 and the cladding portion crimping portion 11 is reduced. Therefore, the distance between the core wire crimping portion 13 and the cladding crimping portion 11 can be decreased so that a whole of the crimp contact 10 can be reduced in size. Basically, the crimping operation need not be modified. Therefore, the crimping operation can be carried out by the use of an existing facility and an existing crimping tool.

Figure 6:
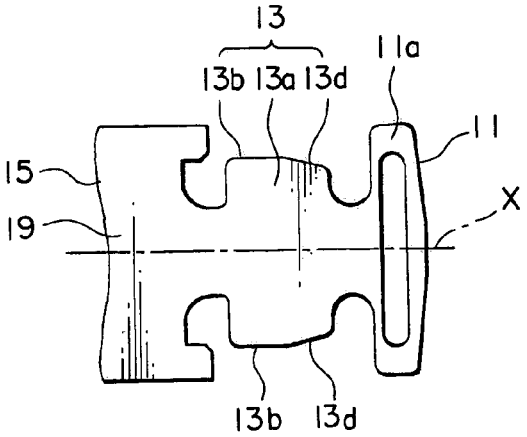
FIG. 6 is a development plan view of a cladding crimping portion and a core wire crimping portion in a modification of the crimp contact illustrated in FIG. 1.

Referring to FIG. 6 in addition to FIGS. 1 and 2, a modification of the crimp contact 10 will be described. Similar parts are designated by like reference numerals and description thereof will be omitted.

In FIG. 6, each of the core wire barrels 13*a* has an inclined portion 13*d* formed at a part of the extending end 13*b*. Specifically, the inclined portion 13*d* is formed on the extending end 13*b* at a part relatively near to the cladding crimping portion 11 than the intermediate point of the core wire barrel 13*a* in the predetermined direction, i.e., at the second part. Along the inclined portion 13*d*, the height H (see FIG. 2) from the base surface 19*a* of the base portion 19 to the extending end 13*b* of the core wire barrel 13*a* is gradually lowered from the intermediate point of the extending end 13*b* of the core wire barrel 13*a* in the predetermined direction towards the cladding crimping portion 11. Thus, the length of the second part from the base portion 19 is gradually shortened towards the cladding crimping portion 11.

In the modification described above, the core wire barrel 13*a* is provided with the inclined portion 13*d*. With this structure, it is possible to delay bending of a part of core wire barrel 13*a* corresponding to the inclined portion 13*d* in an early stage of crimping. Therefore, it is possible to slowly clamp the core wire 23 at the specific part having the length L1 in FIG. 4.

The above-mentioned crimp contact may be used as a component of a cable connector for connecting electronic apparatuses to each other or module units such as disk units to each other.

While this invention has thus far been described in connection with the preferred embodiment thereof, it will be readily possible for those skilled in the art to put this invention into practice in various other manners without departing from the scope set forth in the appended claims. For example, although the description is made about the core wire crimping portion comprising two core wire barrels, the core wire crimping portion may comprise only a single core wire barrel.

What is claimed is:

1. A crimp contact to be connected to a cable having a conductive core wire and an insulating cladding portion covering the core wire, the crimp contact comprising:

a cladding crimping portion for crimping the cladding portion; and a core wire crimping portion arranged adjacent to the cladding crimping portion for crimping the core wire, the core wire crimping portion comprising:

a base portion for receiving the core wire; and a first core wire barrel extending from the base portion for crimping the core wire to cover an outside of the core wire, the first core wire barrel having a relatively longer length from the base portion at a part relatively far from the cladding crimping portion and a relatively shorter length from the base portion at another part relatively near to the cladding crimping portion; and a second core wire barrel extending from the base portion and cooperated with the first core wire barrel for crimping the core wire to cover the outside of the core wire, the second core wire barrel having a first part relatively far from the cladding crimping portion, a second part relatively near to the cladding crimping portion, the second part being shorter in length from the base portion than the first part, and an extending end, the extending end having a step portion between the first and the second parts.

2. The crimp contact according to claim 1, wherein the second core wire barrel has a relatively longer length from the base portion at a part relatively far from the cladding crimping portion and a relatively shorter length from the base portion at another part relatively near to the cladding crimping portion.

3. The crimp contact according to claim 1, wherein the cladding crimping portion has a pair of cladding barrels covering the cladding portion from the outside.

4. The crimp contact according to claim 1, wherein the first core wire barrel has a first part relatively far from the cladding crimping portion and a second part relatively near to the cladding crimping portion, the second part is shorter in length from the base portion than the first part.

5. The crimp contact according to claim 4, wherein the first core wire barrel has an extending end, the extending end having a step portion between the first and the second parts.

6. The crimp contact according to claim 4, wherein the first core wire barrel has an extending end, the extending end having an inclined portion formed at the second part so that the length from the base portion to the extending end is shorter away from the first part.

7. The crimp contact according to claim 1, wherein the first and the second core wire barrels are connected to opposite sides of the base portion, respectively, and faced to each other with a space left therebetween.

8. The crimp contact according to claim 7, wherein the first and the second core wire barrels are symmetrical with each other with respect to a plane between the first and the second core wire barrels.

* * * * *